United States Patent [19]

Bollag

[11] Patent Number: 4,856,931

[45] Date of Patent: Aug. 15, 1989

[54] PROCESS AND DEVICE FOR PRODUCING OR RENEWING A HORIZONTAL MARKING ON ROADS AND HORIZONTAL MARKING PRODUCED IN ACCORDANCE WITH THE PROCESS

[75] Inventor: Moses Bollag, Geneva, Switzerland

[73] Assignee: Plastiroute S.A., Geneva, Switzerland

[21] Appl. No.: 177,911

[22] Filed: Mar. 31, 1988

[51] Int. Cl.[4] ..... E01C 7/32

[52] U.S. Cl. ..... 404/75; 404/93; 427/136; 427/137

[58] Field of Search ..... 404/9, 14, 16, 93, 94; 427/136, 137

[56] References Cited

U.S. PATENT DOCUMENTS

| | | | |
|---|---|---|---|
| 2,268,537 | 12/1941 | Shuger | 404/14 X |
| 2,330,843 | 10/1943 | Rodli et al. | 404/14 X |
| 2,689,801 | 9/1954 | D'Alelio | 404/94 X |
| 2,821,890 | 2/1958 | Wilson | 404/94 |
| 2,897,733 | 8/1959 | Shuger | 404/14 X |
| 3,005,790 | 10/1961 | Wynn et al. | 404/14 X |
| 3,030,870 | 4/1962 | Gill, Jr. | 404/14 X |
| 3,036,928 | 5/1962 | Poole | 404/14 X |
| 3,204,537 | 9/1965 | Searight | 404/14 X |
| 3,286,605 | 9/1964 | Wilson et al. | 404/94 |
| 3,642,675 | 2/1972 | McKenzie | 404/14 X |
| 3,746,425 | 7/1973 | Eigenmann | 404/14 X |
| 4,020,211 | 4/1977 | Eigenmann | 404/14 X |
| 4,117,192 | 9/1978 | Jorgensen | 404/94 X |
| 4,299,874 | 11/1981 | Jones et al. | 404/14 X |
| 4,751,140 | 6/1988 | Ishihara | 404/14 X |

FOREIGN PATENT DOCUMENTS

| | | | |
|---|---|---|---|
| 124946 | 11/1984 | European Pat. Off. | 404/93 |
| 2441546 | 3/1975 | Fed. Rep. of Germany | 404/14 |
| 3133156 | 3/1983 | Fed. Rep. of Germany | 404/93 |
| 590367 | 8/1977 | Switzerland | 404/14 |
| 618755 | 8/1980 | Switzerland | 427/137 |
| 2006307 | 5/1979 | United Kingdom . | |

*Primary Examiner*—Jerome W. Massie, IV
*Assistant Examiner*—Gay A. Spahn
*Attorney, Agent, or Firm*—Lowe, Price, LeBlanc, Becker & Shur

[57] ABSTRACT

During the laying of a marking line with the aid of at least one paint spray gun (2), profile particles (5) are introduced by means of a profile particle dispenser (4) into the marking composition (3) and thereby enveloped all round by the latter. The dimension of the profile particles (5), which are preferably reflective beads, is greater than the layer thickness of the bare painted line, so that profile elevations are formed. Subsequently, reflective beads (8) which also adhere to the profile elevations are scattered onto this profiled painted line (6), which beads thus ensure a good night visibility in wet conditions and when a water film is present, from which they project. The profile particles (5) can either be directly introduced into the jet of paints emerging from the paint spray gun (2) or, subsequent to the application of a painted line, be scattered thereon and then completely covered with marking composition by means of renewed spraying of a thin film of paint.

12 Claims, 4 Drawing Sheets

PROCESS AND DEVICE FOR PRODUCING OR RENEWING A HORIZONTAL MARKING ON ROADS AND HORIZONTAL MARKING PRODUCED IN ACCORDANCE WITH THE PROCESS

FIELD OF THE INVENTION

The invention relates to a process for producing or renewing a horizontal marking on roads, in particular of boundary, broken and warning lines, to a road marking vehicle for carrying out this process and to a horizontal marking produced in accordance with this process.

PRIOR ART

The production of such horizontal markings having reflective beads embedded in the marking composition has long been known and is for example described in EP-A-0 124 946. These road markings are generally also easily recognizable in the dark, when the road is dry, due to the reflective beads which are visible in the car headlights. However, they fulfil their task only unsatisfactorily or not at all when it is raining or when the road is damp for other reasons, because the retroreflection from carriageway markings which are partly or completely covered by a film of water, is greatly reduced or virtually no longer present. The headlight emitted by a vehicle is namely reflected specularly by the water surface and not retroreflectively back to the driver of the vehicle. It is known that retroreflection is understood as the reflection, largely independent of the entrance direction, of the incident light by means of particles acting refractively or specularly.

The great reduction in the visibility of the markings when it is raining plays a decisive role in night accidents.

Previous attempts to increase the night visibility important for road safety when it is wet and raining concentrate on profiling carriageway markings in a suitable way, so that elevations projecting out from the water film are designed with surface areas which are orientated as steeply as possible to the incident headlight. In this way, at these surface areas from which the water runs off, the specular reflection is reduced and the retroreflection is increased.

For this purpose, it is essentially suggested in the previously mentioned EP-A 0 124 946 to lay as a painted line a thin layer marking which continues after application to remain plastically deformable for a long time, to scatter glass beads on the freshly painted line, a certain proportion thereof consisting of floatation beads which have undergone a surface treatment to minimize the depth to which they sink in, and to deform the painted line by pressing in a surface profile before the marking composition has completely hardened. Such profilings, impregnated after the marking has been applied, require however on the one hand a further, separate working operation and can therefore only be produced with considerable working effort and on the other hand they are generally subject to a relatively rapid abrasion or are levelled off after a short time.

Similar disadvantages apply to known thick-layer markings which can be provided with thicker profiles than thin-layer markings but which have a hardening or pot time of in general only a few minutes and are therefore no longer permanently deformable even a short time after laying. Therefore, the profiling of a freshly laid thick-layer marking must be pressed in immediately after its application, this work being very delicate because of the only short time of a few minutes available.

It is also known, when laying thick-layer markings where it is a question of hot-extruded or hard plastic compositions which are not sprayable but which must be applied for example with a laying shoe, to shape profiles in the form of studs or toric transverse ribs which are arranged at a distance from one another.

A disadvantage common to all hot-extruded or hard plastic compositions is that devices required for their laying are quite complicated and costly and that the laying work can only be performed slowly, so that daily output is low compared to the rapidly performed processing of sprayable marking compositions. Above all, that also applies to the laying of the toric profiles mentioned, which are produced intermittently and are, on the one hand, easily deformed and rubbed off during snow clearing due to their relatively high and steep edges and, on the other hand, themselves impede snow clearing because the snowplough pushes against the profile edges and can even be damaged in the process. Furthermore, a satisfactory re-marking, that is the renewal of a profiled thick-layer marking according to the same process by which it was produced is, virtually impossible, so that the maintenance of such markings is made difficult and more expensive. Due to the difficulties mentioned and the high costs, hot-extruded or hard plastic markings are only relatively seldom laid; some 90% to 95% of all markings are thin-layer or medium-layer markings which can be produced quickly and cheaply by spraying, but which could not previously be provided with profiles in an efficient and effective manner.

In addition, it is known to produce films having surface structure, for example pyramid-shaped, and to secure them on the road surface, which is however awkward and costly.

To achieve good night visibility in wet conditions poses, therefore, a problem which has not yet been satisfactorily solved, so that it has not yet been possible to increase road safety in darkness and rain by easily visible marking lines, as is desirable.

SUMMARY OF THE INVENTION

The object of the invention is to establish a process by which, in a relatively cheap and simple manner, a horizontal marking provided with surface profiles is produced, having good night visibility also in wet conditions, a high stability against abrasion and levelling off and, consequently, an economical service life and can in addition be renewed without difficulties by re-drawing.

This process according to the invention makes it possible to produce the surface profiles during the laying of the painted line, in a joint working operation therefore, during which the section to be processed is passed over only once with an appropriately equipped marking vehicle; in the course of this operation, small profiles completely covered with marking composition in the style of painted studs are produced to which the subsequently scattered reflective beads adhere, as small retroreflective beads. A profiled horizontal marking produced in this way is particularly economical because, it can constantly be drawn as a normal thin-layer, or medium-layer marking by spraying as part of the customary, usually applied marking work without a second working operation being necessary for production of the surface profiles. Thin-layer and medium-layer markings have wet-film thicknesses of approximately 0.3 to 1.5 mm and shrink when drying by 20% to 40%, so that the dry-film thicknesses are correspondingly less.

A further essential advantage consists in that the profile particles projecting from the actual painted line due to their size are completely enveloped by marking composition and are, therefore, stably anchored in the painted line so that the danger of these profile particles being ripped out by the traffic running over them is greatly reduced. Furthermore, they do not impede snow clearing because the slowplough is always supported on a large number of profiles and therefore always works in the tangential plane to the vertexes of the profiles without running against profile edges. For this reason, the danger of the profiles for their part being damaged during snow clearing and the profile particles being pressed out is only very slight.

A further advantage consists in the possibility of worn profiled markings being renewed readily by redrawing, which was not readily possible in the case of the previously known profiled markings.

If, preferably, appropriately dimensioned reflective beads or other reflecting, at least approximately spherical, particles are used as profile particles, there is the further advantage that the areas of the profile particles projecting from the painted line themselves contribute to the reflection and retroreflection, as soon as the paint layers adhering to these areas have been rubbed off by the traffic. Such a horizontal marking according to the invention therefore also retains its good night visibility in wet conditions when it is considerably worn, as long as sufficient profile particles are still present.

As a result of the invention, therefore, a night visibility of carriageway markings in rainy weather is achieved which is significantly better and longer lasting than was previously possible; that applies particularly to carriageway boundary lines as well as to broken and warning lines, the recognition of which is especially important for road safety.

The process according to the invention may be carried out in such a way that the profile particles are laid simultaneously with the spraying of the marking composition in that they are scattered or shot into the pointed jet of paint or in the direct vicinity of the point of impingement of the jet. It is, however, also possible to proceed in such a way that firstly a painted line is sprayed, immediately afterwards the profile particles are scattered thereon and then marking composition is once again applied in order to completely envelop the profile particles.

A road marking vehicle for carrying out the process according to the invention is also described.

Expedient developments of the process and of the device result from the dependent patent claims.

BRIEF DESCRIPTION OF THE DRAWINGS

The invention is explained in more detail with the aid of drawings of diagrammatically illustrated exemplary embodiments. They show.

DESCRIPTION OF THE PREFERRED EMBODIMENT

Figure 1:
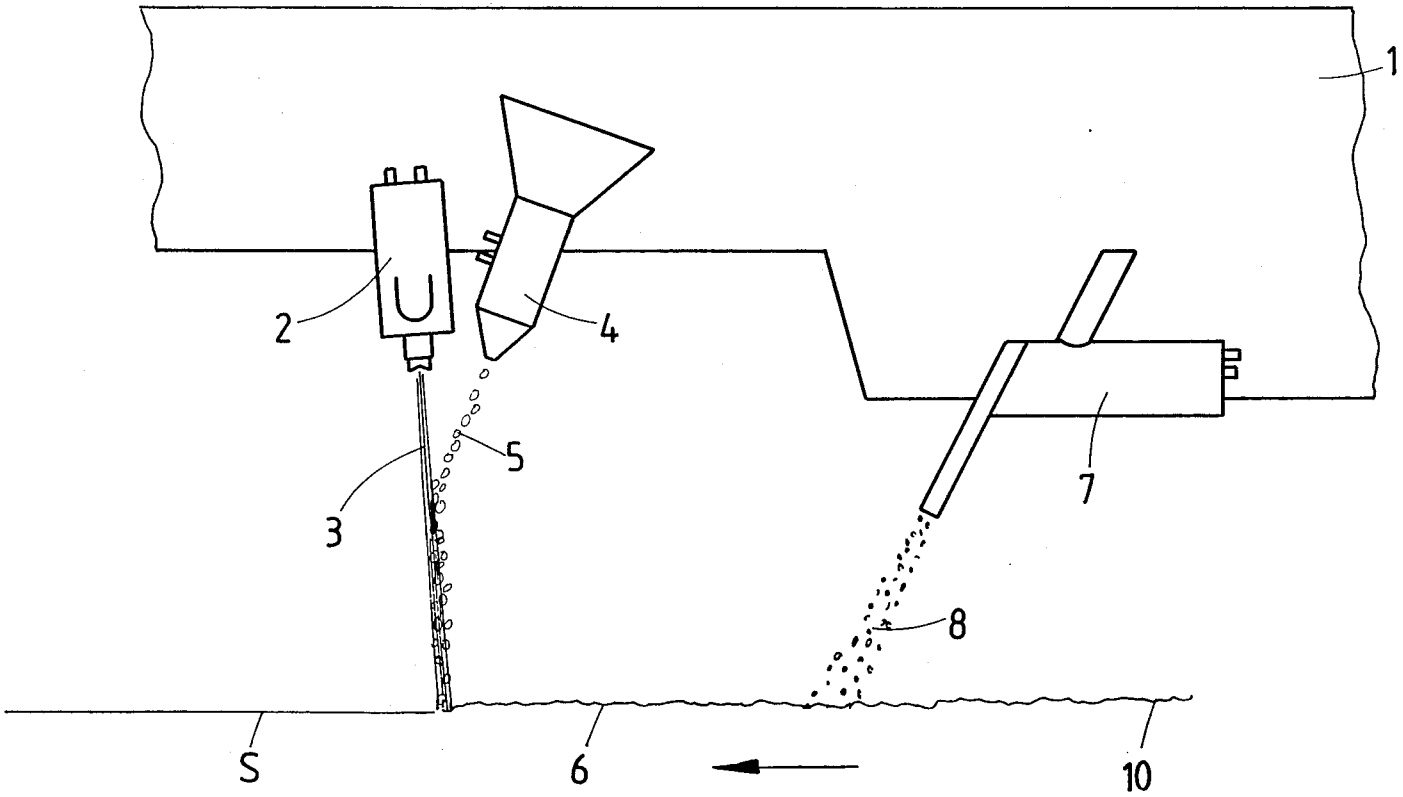
FIG. 1 a first example of a marking vehicle, only indicated, having a paint spray gun into whose jet profile particles are introduced.

According to FIG. 1, a paint spray gun 2, a profile particle dispenser 4 and behind them, seen in the direction of travel, a bead scatterer 7 are arranged on the marking vehicle 1, only diagrammatically indicated, which moves in the direction of the arrow. The paint spray gun 2 sprays marking composition 3 in a known manner onto the road surface S in the form of a fan-shaped jet transverse to the direction of travel. The profile particle dispenser 4, mounted in the immediate vicinity of the paint spray gun 2, is directed onto the somewhat inclined jet of paint so that profile particles 5 enter the sprayed marking composition 3 before the jet impinges upon the road surface S. In this way, the profile particles 5 are covered completely with marking composition.

Figure 5B:
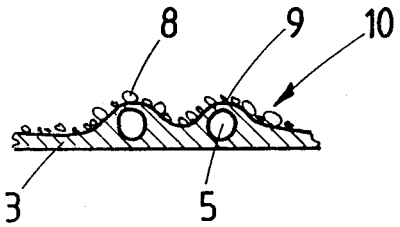

The minimum dimension of the profile particles 5, reflective beads in the example considered is greater than the dry-film thickness or the layer thickness of the actual painted line. Therefore, as illustrated in FIG. **5*a*, the horizontal marking 6 produced has surface profiles 9 in the form of painted studs, which are formed by means of the projecting areas of the profile particles 5 completely covered by marking composition. Subsequently, reflective beads 8 are scattered onto the still fresh profiled painted line 6 by means of the bead scatterer 7. The finished painted line 10 thus obtained, illustrated in FIG. 5*b*, has therefore surface profiles 9 provided with reflective beads 8**.

These scattered reflective beads 8 may be a customary mixture of normal reflective beads whose diameter is between 0.05 and 0.8 mm and which are therefore smaller than the profile particles 5.

However, in order to increase the effect of the retroreflection between the profile elevations, the scattered reflective beads can advantageously also contain large reflective beads having a diameter of at least 0.8 mm, preferably of approximately 1 to 2 mm, which naturally improve the visibility of the marking particularly well. Whilst such large reflective beads would be ripped out of a level marking relatively quickly by the traffic running over them, in the case of a marking according to the present invention, they are extensively protected by the neighbouring profile elevations, since the tyres of the vehicles running over them are essentially supported on the profile elevations and do not stress, or stress only insignificantly, the reflective beads lying between them. In order that this protective effect acts well, the profile elevations in the middle should be of a height such that they project somewhat from the large beads which lie between them. In the case of such a marking, on the one hand the normal reflective beads which adhere to the profile elevations and on the other hand the large reflective beads located between the profile elevations retroflect above all.

The marking composition used is preferably a simple and efficient to lay thin-layer or else medium-layer marking, whose solids are dissolved for the application in a solvent and which, in the case of single-component paints, harden exclusively by evaporation of the solvent and in the case of multi-component paints harden by evaporation of the solvent as well as by chemical drying. In this case, the wet-film thicknesses amount to approximately 0.3 mm to 1.5 mm, which corresponds to dry-film thicknesses of approximately 0.2 mm to approximately 0.8–1.2 mm.

The profile particles 5 are at least 0.6 mm larger than the dry-film thickness and can, dependent on paint-layer thickness, have diameters between approximately 1 mm and 6 mm, these sizes naturally being selected in such a way that the profile particles, whilst being anchored as stably as possible in the painted line, have a sufficient profile height. This diameter range is expedient for roads which are regularly cleared of snow in the winter and therefore profiles which are too high should not be present. In special cases, in particular in regions where snow clearing does not take place or is not necessary, profile particles with diameters up to a maximum of 8 mm or even 10 mm can also be used.

In the example considered, the dry-film thickness of the bare painted line at the places where only marking composition 3 and no profile particles are present amounts to approximately 1 mm and the diameter of the profile particles amounts to approximately 3 mm, so that the profile elevations 9 covered with paint and small reflective beads 8 project by approximately 2 to 3 mm from the actual painted line. Preferably, under the separate reflective beads 8 there are also large reflective beads having diameters of approximately 1–2 mm which lie protected between profile elevations and which further increase retroreflection. The maximum overall layer thickness of the finished line 10, measured at the profile elevations, is then approximately 3 to 4 mm.

Instead of a thin-layer or medium-layer marking, a sprayable thick-layer marking can also be used.

The profile elevations, from which the water runs off, which are present at the positions of the profile particles 5, are virtually never completely awash with a film of water in rainy weather and therefore guarantee a good night visibility even when it is raining; in addition, they prevent the formation of a continuous water film and have the constant effect of dispersing the water running off. Therefore, the profile elevation 9 covered with small glass beads 8 reflect even in rainy weather and make the marking easily visible by means of retroreflection. Especially in the case of carriageway boundary lines which are after all located outside the carriageway lane and are therefore wet and covered with water usually for some time in rainy weather, this night visibility is particularly essential and contributes decisively to road safety. Due to the only relatively low profile heights, on the other hand, the process in accordance with the invention is also suitable for the production of centre lines, broken lines and warning lines.

If reflective beads are preferably used as profile particles, that has the additional advantage that the marking fulfils its task at night and in wet conditions even after the paint has been rubbed off from the surface profiles 9, because from then on the exposed areas of the profile particles themselves reflect.

In order to improve the skid resistance of the marking, it is recommended that the profile particles used comprise at least in part irregularly shaped mineral particles, for example chippings, gravel, broken glass or the like, which furthermore adhere particularly firmly to the marking composition due to their angular shape and thus increase the durability of the profiles, these particles being preferably mixed with reflective beads. Naturally, particles of other suitable material, for example of plastic, and of any shape, for example in the form of ellipsoids or polyhedras, can also be used.

In the example according to FIG. 1, the profile particle dispenser 4, which is a pneumatic spray gun, is aligned at a slight angle to the likewise slightly inclined jet of the paint spray gun 2, so that the profile particles 5 are shot into this jet at an acute angle. The dispenser 4 can also be a simple scattering device and in this case it is installed vertically, above the inclined jet, so that the profile particles fall vertically onto and into this jet.

Figure 2:
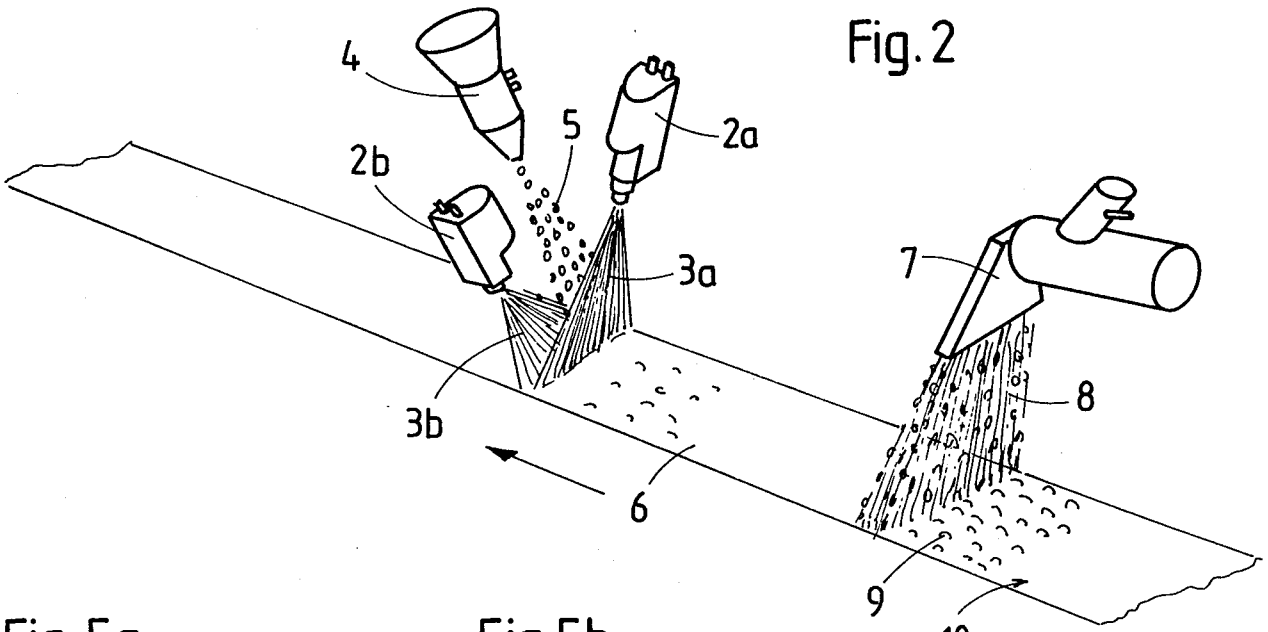
FIG. 2 a second example having two paint spray guns spraying one painted line, which guns are arranged transversely to the direction of travel next to one another.
Figure 5A:
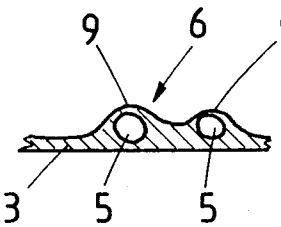

In the example according to FIG. 2, the painted line 6 is produced with the aid of two paint spray guns **2*a* and 2*b* arranged at an angle to each other and next to each other tranversely to the direction of travel, each delivering a fan-shaped jet 3*a* and 3*b*. Both fan-shaped jets lie at least approximately in a plane and overlap each other. The profile particle dispenser 4 is located in the middle between the two paint spray guns and scatters or shoots the profile particles 5 between the two fan-shaped jets of paint 3*a* and 3*b* into the marking composition, before the latter impinges upon the road surface S. At a distance behind this arrangement is the bead scatterer 7, for applying small reflective beads 8. The painted lines 6 and 10, disgrammatically illustrated in FIGS. 5*a* and 5*b***, are produced in turn. The two jets of paint can also impinge contiguously on the road surface without overlapping, each producing half the line width.

Figure 3:
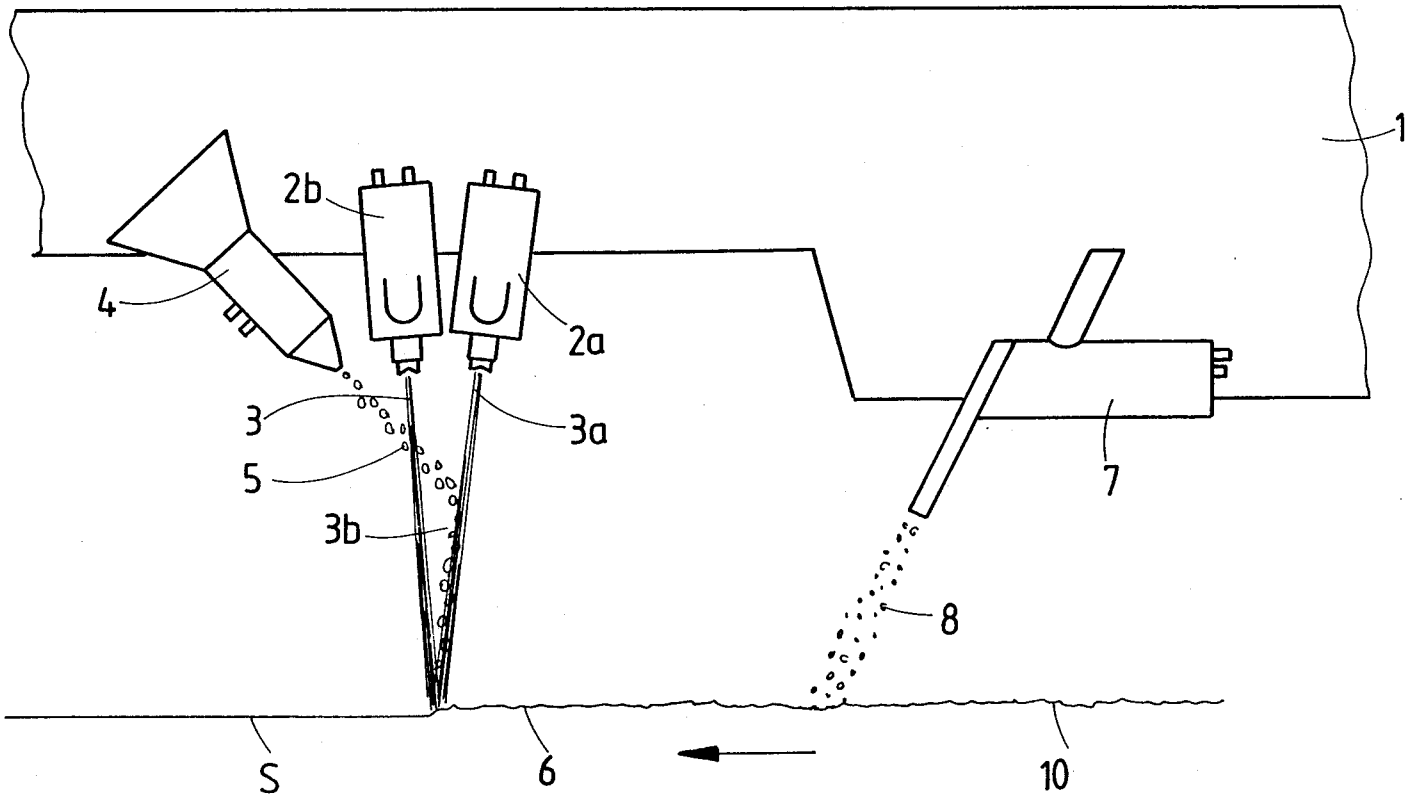
FIG. 3 a third example, in which two paint spray guns producing a painted line are arranged one behind the other in the direction of travel.

In the example according to FIG. 3, the marking vehicle, not illustrated in more detail, in turn has, for the drawing of a marking line, two paint spray guns **2*a* and 2*b*, positioned at an angle to each other, which are, in this case, positioned one behind the other in the direction of travel in such a way that the two fan-shaped jets of paint 3*a* and 3*b* impinge upon the road surface S at least approximately in a common line. A profile particle dispenser 4 in the form of a pneumatic gun is arranged inclined in front of the two paint spray guns in the direction of travel in such a way that the expelled profile particles 5 are thrown at a certain angle against and through the front jet of paint 3*b* so that they are entrained partly by the front jet of paint 3*b*, partly by the rear jet of paint 3*a* or caught between the two jets of paint. Of course, the profile particle dispenser 4 can also be arranged in the middle between the two paint spray guns 2*a* and 2*b* and be positioned essentially vertically so that the expelled profile particles arrive directly between the two jets of paint. In this case too, a bead scatterer 7 for the application of small reflective beads 8 on the painted line 6 is provided so that the profiled painted line 10** coated with reflective beads is again produced.

Figure 4:
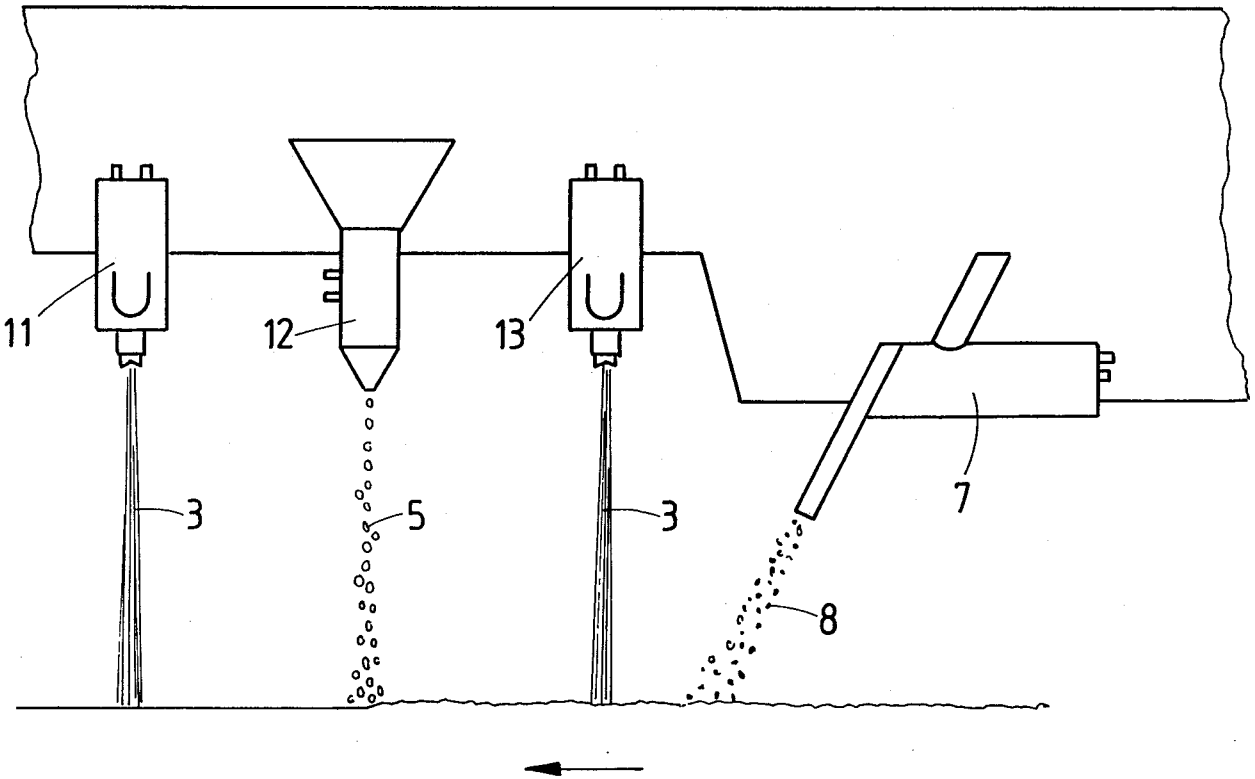
FIG. 4 a fourth example of a marking vehicle, with which profile particles are scattered onto the initially laid painted line and then covered with marking composition, and FIGS. 5 and **5*b*** a diagrammatic section through a horizontal marking according to the invention, provided with surface profiles, before and after the scattering of small reflective beads.

Instead of mixing the profile particles directly with the marking composition emerging from the paint spray guns, the procedure as shown in FIG. 4 can also be followed. In this case, a first paint spray gun 11 is initially used to spray a painted line, whose layer thickness is somewhat less than corresponds to the final layer thickness desired. Using a profile particle dispenser 12 installed behind this paint spray gun 11, profile particles 5 are then scattered on the fresh painted line and subsequently marking composition 3 is again sprayed, by means of a second spray gun 13, onto the painted line coated with profile particles 5 so that the profile particles are completely covered with a film of paint. Finally, reflective beads 8, which preferably also include the large reflective beads mentioned, are in turn scattered. Instead of drawing the painted line with only one paint spray gun 11, two paint spray guns, as in accordance with FIGS. 2 or 3, can also be used for this purpose.

All devices mentioned for the production of the complete, profiled marking are installed on a common marking vehicle which, whilst passing over the section to be processed once, permits this marking to be produced or renewed rapidly and economically.

I claim:

1. Process for producing or renewing a horizontal marking on roads, in particular of boundary lines, broken lines and warning lines, whereby a painted line is applied by spraying a marking composition and subsequently reflective beads are scattered on the still fresh painted line, characterized in that, before the reflective beads are scattered thereon, profile particles, whose minimum dimension is greater than the dry film thickness of the newly applied painted line, are introduced into the painted line and are completely enveloped in marking compositions, so that a marking having profile elevations is produced, and further characterized in that profile particles are used whose minimum dimension is greater than the dry film thickness of the applied painted line by at least 0.6 mm.

2. Process according to claim 1, characterized in that, during the application of the painted line, profile particles are introduced into a jet of the sprayed marking composition, two paint spray guns being used which simultaneously draw one painted line and which produce fan-shaped jets which impinge upon the road surface at least approximately in a common line, the profile particles being preferably introduced into the marking composition between the two jets.

3. Process according to claim 1, characterized in that first a painted line is sprayed, in that the profile particles are then applied to the still fresh painted line, and in that subsequently, before the reflective beads are scattered, the painted line coated with profile particles is again sprayed with marking composition so that the profile particles are covered with a paint film.

4. Process according to any one of claims 1 to 3, characterized in that, the profile particles used comprise at least in part reflective beads having an at least approximately spherical shape.

5. Process according to any one of claims 1 to 3, characterized in that, the profile particles used comprise at least in part irregularly shaped particles from the group consisting of chippings, gravel and broken glass.

6. Process according to any one of claims 1 to 3, characterized in that, reflective beads having a diameter of at least 0.8 mm and up to 2 mm, are at least in part used when scattering the reflective beads on the painted line which is provided with profile elevations.

7. Process according to claim 1, characterized in that, the profile particles used comprise at least in part irregularly shaped particles from the group consisting of chippings, gravel and broken glass, mixed with glass beads.

8. Process according to claim 1, characterized in that, during the application of the painted line, profile particles are scattered in an immediate vicinity of an impingement point of the jet, two paint spray guns being used which simultaneously draw one painted line and which produce fan-shaped jets which impinge upon the road surface at least approximately in a common line, the profile particles being preferably introduced into the marking composition between the two jets.

9. Process for producing or renewing a horizontal marking on roads, in particular of boundary lines, broken lines and warning lines, comprising the steps of:

(a) applying a painted line by spraying a marking composition, (b) introducing into said painted line profile particles whose minimum dimension is greater than the dry film thickness of the applied painted line by at least 0.6 mm such that said profile particles are completely enveloped in the marking composition and form painted profile elevations for supporting and protecting reflective beads subsequently applied thereto, said profile particles having diameters of at least 1 mm, and (c) subsequently applying said reflective beads on the still fresh painted line and covering said painted profile elevations therewith, said reflective beads comprising particles having diameters smaller than the diameters of said profile particles, thereby improving night visibility of the painted line at night under rainy conditions.

10. A process as recited in claim 9 wherein said step of introducing profile particles comprises introducing profile particles having diameters in the range of 1 mm and 6 mm and said step of subsequently applying said reflective beads comprises applying reflective beads having diameters in the range of 0.05 mm to 0.8 mm.

11. A process as recited in claim 9 wherein said step of introducing profile particles comprises introducing profile particles having diameters at least 1.8 mm.

12. A process as recited in claim 11 wherein said step of introducing profile particles comprises introducing profile particles having diameters in the range of 8 to 10 mm and said step of subsequently applying said reflective beads comprises applying reflective beads having diameters of less than 2 mm.

* * * * *